US006449841B1

(12) United States Patent
Endo et al.

(10) Patent No.: US 6,449,841 B1
(45) Date of Patent: Sep. 17, 2002

(54) METHOD AND APPARATUS OF PRESS-CONNECTING AN ELECTRIC WIRE WITH A PRESS-CONNECTING TERMINAL

(75) Inventors: Takayoshi Endo; Toshiaki Okabe, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 226 days.

(21) Appl. No.: 08/922,521

(22) Filed: Sep. 3, 1997

(30) Foreign Application Priority Data

Sep. 3, 1996 (JP) ..... 8-233378

(51) Int. Cl.[7] ..... H01R 43/04
(52) U.S. Cl. ..... 29/861; 29/858; 29/753
(58) Field of Search ..... 29/861, 866, 865, 29/867, DIG. 21, DIG. 24, 749, 753, 858; 392/419, 420; 219/85.12, 85.13, 85.18

(56) References Cited

U.S. PATENT DOCUMENTS 4,107,838 A * 8/1978 Keen et al. ..... 29/850
4,533,193 A * 8/1985 Blackwood ..... 29/374
4,870,747 A * 10/1989 Maack et al. ..... 29/753
5,018,269 A * 5/1991 Ishida et al. ..... 29/861
5,099,570 A * 3/1992 Gerhard, Jr. ..... 29/751
5,465,478 A * 11/1995 Anderson et al. ..... 29/748
5,768,766 A * 6/1998 Hatagishi et al. ..... 29/753

FOREIGN PATENT DOCUMENTS

JP 4-48569 2/1992 ..... H01R/43/00
JP 7-282943 10/1995 ..... H01R/43/01

* cited by examiner

*Primary Examiner*—Lee Young
(74) *Attorney, Agent, or Firm*—Sughrue Mion, PLLC

(57) ABSTRACT

A method of press-connecting a coated electric wire with a press-connecting terminal, including the step of pressing an end portion of the coated electric wire into a notched slot provided in a side plate of the press-connecting terminal so as to cut a coating portion of the coated electric wire to thereby make a conductor of the coated electric wire electrically connected to the side plate of the press-connecting terminal. In such a method, before the coated electric wire is press-connected with the press-connecting terminal, the coating portion of the coated electric wire is heated and softened so that the force necessary for pressing the coated electric wire into the notched slot is reduced to be not larger than a predetermined value.

6 Claims, 8 Drawing Sheets

METHOD AND APPARATUS OF PRESS-CONNECTING AN ELECTRIC WIRE WITH A PRESS-CONNECTING TERMINAL

BACKGROUND OF THE INVENTION

1. Field of the Invention

The present invention relates to a method of press-connecting an electric wire with a press-connecting terminal and a press-connecting apparatus used in this press-connecting method.

2. Description of the Related Art

A method of press-connecting an electric wire with a press-connecting terminal as shown in FIGS. 5 and 6 is disclosed in Japanese Patent Unexamined Publication No. Hei. 4-48569. Another method of press-connecting an electric wire with a press-contacting terminal as shown in FIGS. 9 through 11 is disclosed in Japanese Patent Unexamined Publication No. Hei. 7-282943.

As shown in FIGS. 5 and 6, a press-connecting terminal 1 has a terminal portion 3 and a press-connecting portion 5. As shown in FIG. 5, a notched slot 9 is provided in a side plate 7 of the press-connecting portion 5 so that edge portions in opposite sides of the notched slot 9 serve as a pair of press-connecting blades 15 and 15 for cutting a coating portion 13 of a coated electric wire 11.

To press-connect the coated electric wire 11 with the press-connecting terminal 1, as shown in FIG. 6, an end portion of the coated electric wire 11 is pressed against the side plate 7 of the press-connecting portion 5 by a press-connecting jig 17. As a result, the coating portion 13 of the coated electric wire 11 is cut with the pair of press-connecting blades 15 and 15 of the notched slot 9 so that a conductor 19 of the coated electric wire 11 is electrically connected to the notched slot 9. Thus, the coated electric wire 11 is electrically connected to the press-connecting terminal 1.

In the press-connecting method shown in FIGS. 9 through 11, a pair of pressing arms 23 and 23 are provided so that the distance between the pair of pressing arms 23 and 23 is narrowed when a sleeve 21 is moved down as shown in FIGS. 9 and 10. Before a coated electric wire 11 is press-connected with a press-connecting terminal 1, the coated electric wire 11 is squashed with the pair of pressing arms 23 and 23 in the direction of the width of a notched slot 9 as shown in FIG. 10. Then, as shown in FIG. 11, the squashed coated electric wire 11 is pressed against a side plate 7 of the press-connecting terminal 1 by a press-connecting jig 25 so that a coating portion 13 of the coated electric wire 11 is cut with a pair of press-connecting blades 15 and 15 of the notched slot 9 in the same manner as in the aforementioned conventional method. Thus, the coated electric wire 11 is electrically connected to the press-connecting terminal 1.

In the conventional method shown in FIGS. 5 and 6, if the center of the coated electric wire 11 is made displaced even slightly from the center of the notched slot 9 when the coated electric wire 11 having a diameter d is to be press-connected with the press-connecting portion 5 having an inner width h (d=h) as shown in FIG. 7, the coating portion 13 may be however squashed between the press-connecting jig 17 and the press-connecting portion 5 so that the squashed coating portion 13 strongly resists when it is cut with the pair of press-connecting blades 15 and 15 and widens the notched slot 9 in directions of the arrows in FIG. 8.

If the notched slot 9 is widened, the coating portion 13 is cut so insufficiently that the electrical connection between the coated electric wire 11 and the press-connecting terminal 1 fails because of no contact between the conductor 19 and the notched slot 9 or because of shortage of contact load therebetween.

In order to solve this problem, in the conventional method shown in FIGS. 9 through 11, the coated electric wire 11 is squashed in the direction of the width of the notched slot 9 as described above.

After the coated electric wire 11 is press-connected with the press-connecting terminal 1, the notched slot 9 is however widened by elastically restoring force of the coating portion 13 so that the electrical connection between the coated electric wire 11 and the press-connecting terminal 1 fails because of lowering of contact load between the conductor 19 and the notched slot 9.

SUMMARY OF THE INVENTION

Taking such circumstances into consideration, an object of the present invention is to provide a method of press-connecting a coated electric wire with a press-connecting terminal, wherein a notched slot of the press-connecting terminal is prevented from being widened so that a coating portion of the coated electric wire is cut thoroughly to thereby keep the electrical connection between the notched slot and a conductor of the coated electric wire surely.

Another object of the present invention is to provide a press-connecting apparatus used in the aforementioned method.

According to a first aspect of the present invention, there is provided a method of press-connecting a coated electric wire with a press-connecting terminal, comprising the step of: pressing an end portion of the coated electric wire into a notched slot provided in a side plate of the press-connecting terminal so as to cut a coating portion of the coated electric wire to thereby make a conductor of the coated electric wire electrically connected to the side plate of the press-connecting terminal, wherein before the coated electric wire is press-connected with the press-connecting terminal, the coating portion of the coated electric wire is heated and softened so that a force necessary for pressing the coated electric wire into the notched slot is reduced to be not larger than a predetermined value.

According to a second aspect of the present invention, there is provided an apparatus for press-connecting a coated electric wire with a press-connecting terminal, comprising: pressing means for pressing an end portion of the coated electric wire into a notched slot provided in a side plate of the press-connecting terminal to thereby cut a coating portion of the coated electric wire to electrically connect a conductor of the coated electric wire to the side plate of the press-connecting terminal; and heating means for heating and softening the coating portion of the coated electric wire so that a force necessary for pressing the coated electric wire into the notched slot is reduced to be not larger than a predetermined value before the coated electric wire is press-connected with the press-connecting terminal.

DETAILED DESCRIPTION OF THE PREFERRED EMBODIMENTS

Figure 1:
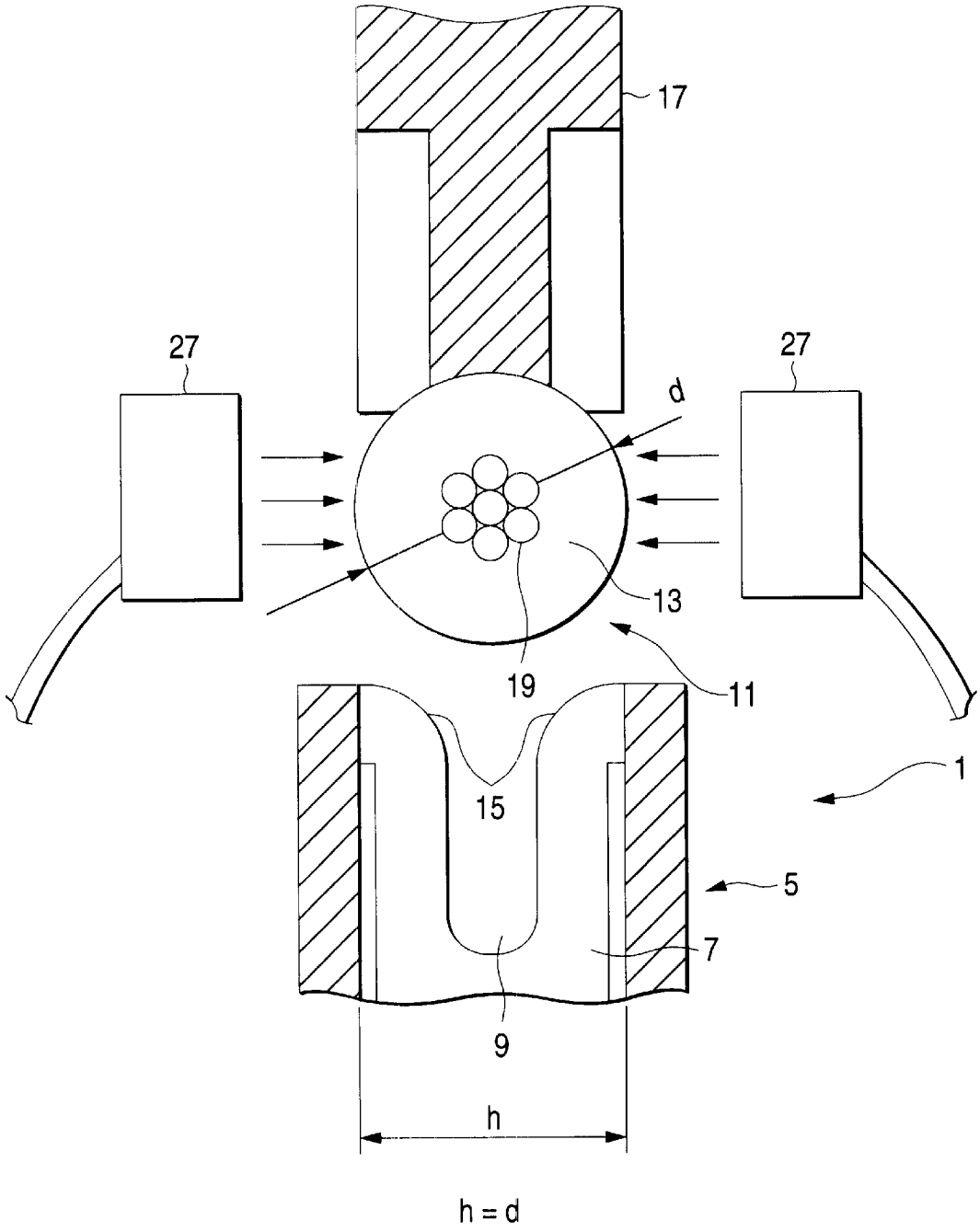
FIG. 1 is a sectional view showing a state in which a coated electric wire is heated before press-connecting treatment in a first embodiment of the present invention.
Figure 2:
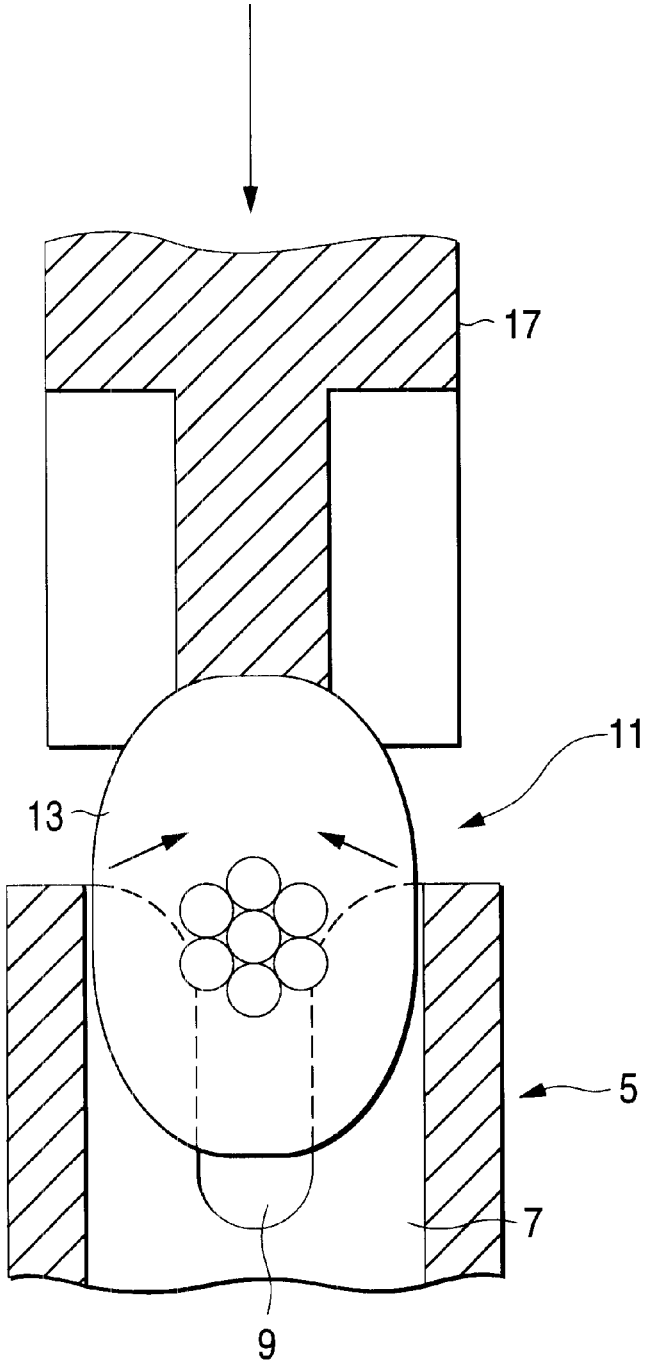
FIG. 2 is a sectional view showing a state in which the coated electric wire is subjected to press-connection after heating in the first embodiment.

Referring to FIGS. 1 and 2, a first embodiment of the present invention will be described below.

As shown in FIG. 1, an apparatus of press-connecting a coated electric wire 11 with a press-connecting terminal 1 has a pair of electric heaters (heating means) 27 and 27. The pair of electric heaters 27 and 27 are disposed in the opposite sides of the coated electric wire 11.

The coated electric wire 11 is heated by the pair of electric heaters 27 and 27 before press-connecting treatment, so that a coating portion 13 of the coated electric wire 11 is softened. When the coated electric wire 11 having the coating portion 13 softened is then pressed against a press-connecting portion 5 of the press-connecting terminal 1 by a press-connecting jig (press-connecting means) 17 as shown in FIG. 2, the coating portion 13 is cut with a pair of press-connecting blades 15 and 15 of a notched slot 9. When the coating portion 13 is cut, a conductor 19 of the coated electric wire 11 is electrically connected to the notched slot 9. Thus, the coated electric wire 11 is electrically connected to the press-connecting terminal 1.

Incidentally, the inner width h of the press-connecting portion 5 is equal to the diameter d of the coated electric wire 11.

The aforementioned heating of the coated electric wire 11 by the pair of electric heaters 27 and 27 is performed in such a temperature and time condition that a force of the press-connecting jig 17 pressing the coated electric wire 11 into the press-connecting portion 5 is set to be not larger than a predetermined value due to the softening of the coating portion 13.

In such a manner, the method and apparatus for press-connecting an electric wire with a press-connecting terminal according to the first embodiment are configured.

Figure 8:
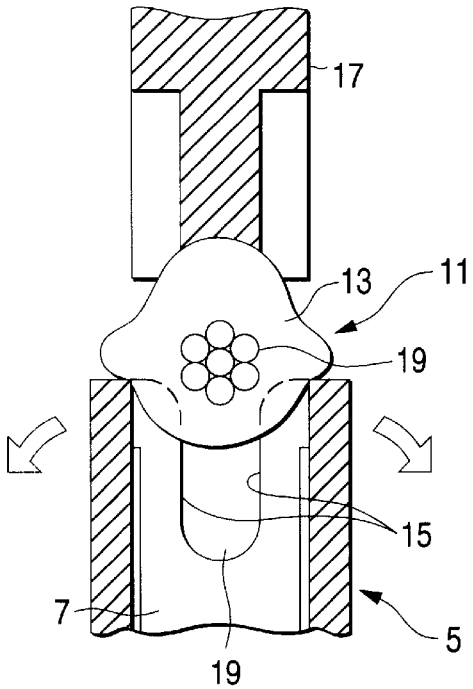
FIG. 8 PRIOR ART
FIG. 8 is a sectional view showing a state in which the coating portion of the coated electric wire is squashed so that a force to widen the notched slot is generated when the coated electric wire is subjected to press-connecting treatment by the first conventional method.

The coating portion 13 heated and moderately softened before press-connecting treatment as described above is cut thoroughly with the pair of press-connecting blades 15 and 15 at the time of press-connecting treatment as shown in FIG. 2. Accordingly, unlike the conventional method shown in FIG. 8, the coating portion 13 is prevented from being squashed between the press-connecting jig 17 and the press-connecting portion 5, so that the notched slot 9 is prevented from being widened by the resistance of the squashed portion.

Because the cutting of the coating portion 13 is performed thoroughly in the aforementioned manner, sufficient contact load is obtained between the conductor 19 and the notched slot 9. Accordingly, excellent electrical connection is obtained between the coated electric wire 11 and the press-connecting terminal 1.

Further, because the notched slot 9 is prevented from being widened, it is possible to narrow the interval or pitch of a number of press-connecting terminals 1 of a connector in which the press-connecting terminals 1 are received. Furthermore, because the force to widen the notched slot 9 is not applied to the notched slot 9, the thickness of each press-connecting terminal 1 can be reduced. Accordingly, the interval or pitch of the press-connecting terminals of the connector can be further narrowed.

Accordingly, the number of press-connecting terminals to be received in the connector can be increased correspondingly advantageously.

Further, because the coating portion 13 is softened, press-connecting treatment is performed normally even in the case where the center of the coated electric wire 11 is somewhat displaced from the center of the notched slot 9. Accordingly, the center of the coated electric wire 11 is allowed to be somewhat displaced from the center of the notched slot 9.

Figure 3:
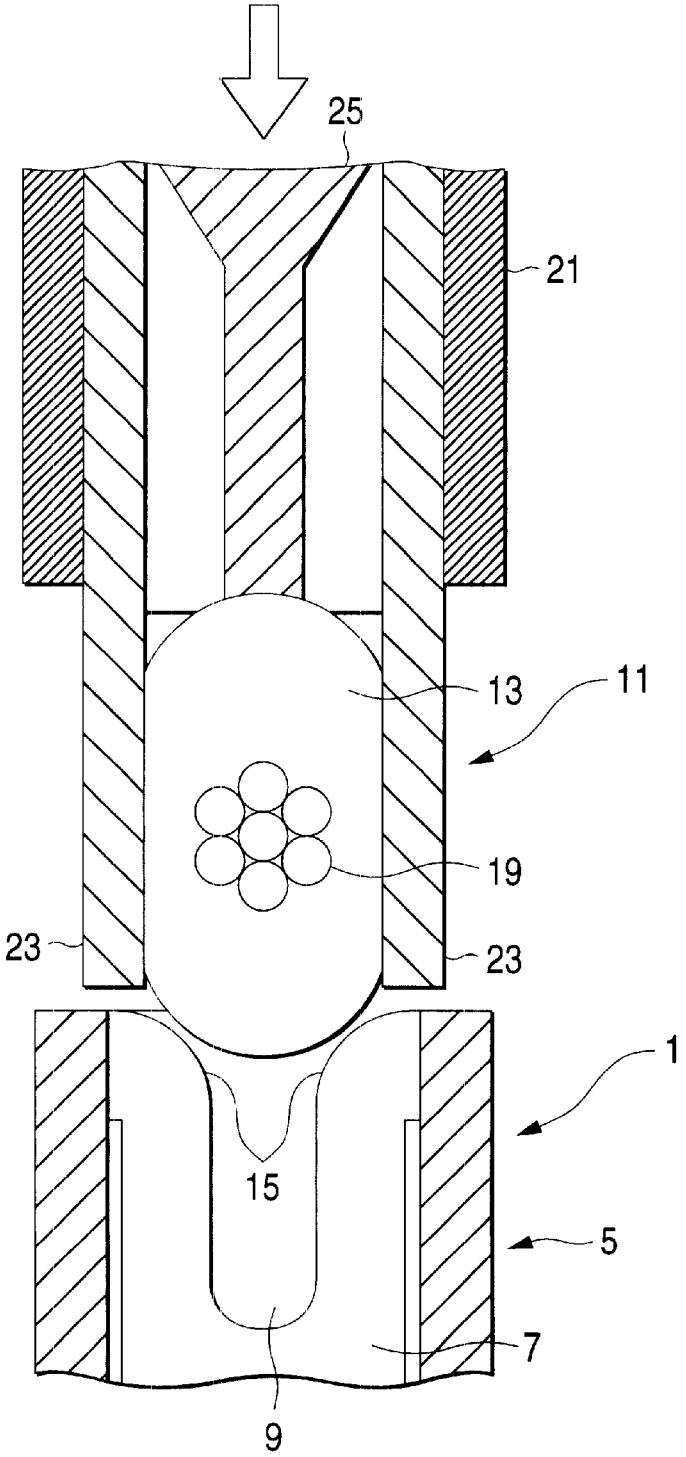
FIG. 3 is a sectional view showing a state in which a coated electric wire is squashed while being heated by a pair of pressing arms before press-connecting treatment in a second embodiment of the present invention.
Figure 4:
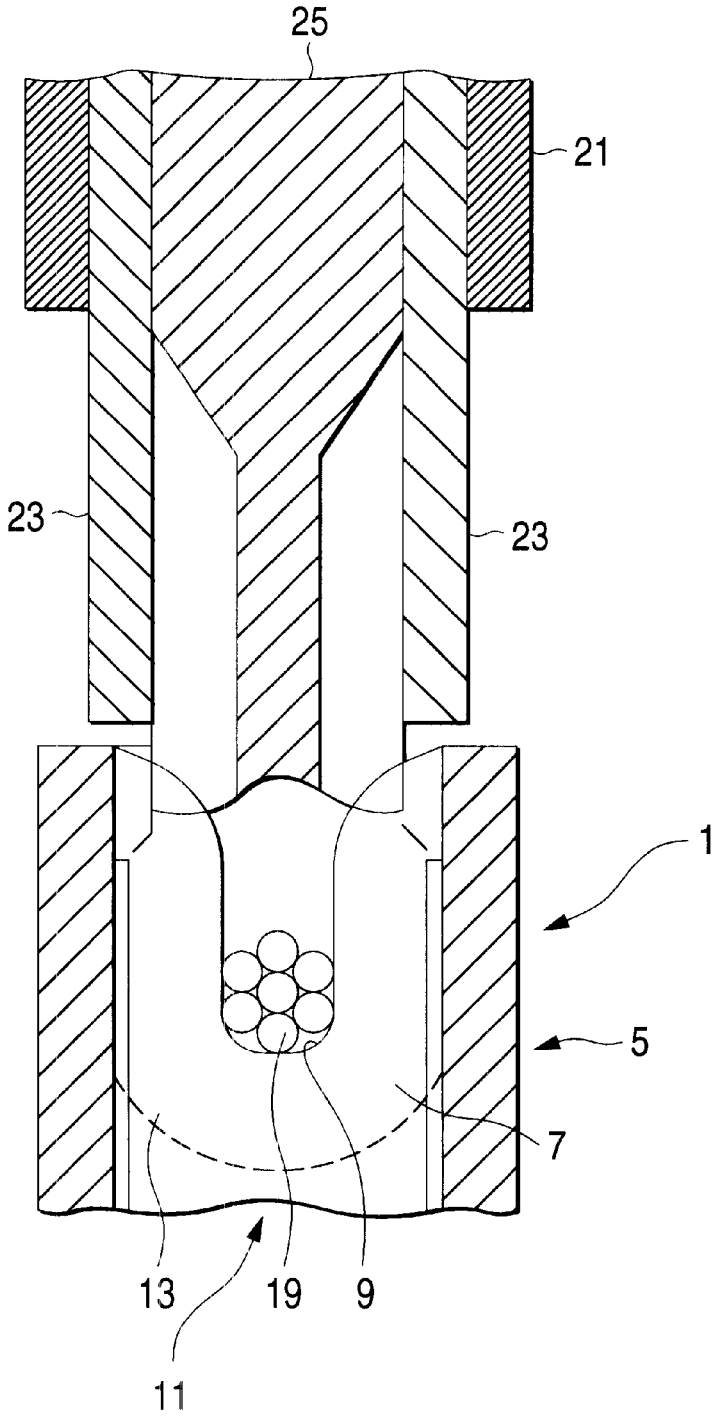
FIG. 4 is a sectional view showing a state in which the coated electric wire is subjected to press-connecting treatment after heating and squashing in the second embodiment.
Figure 5:
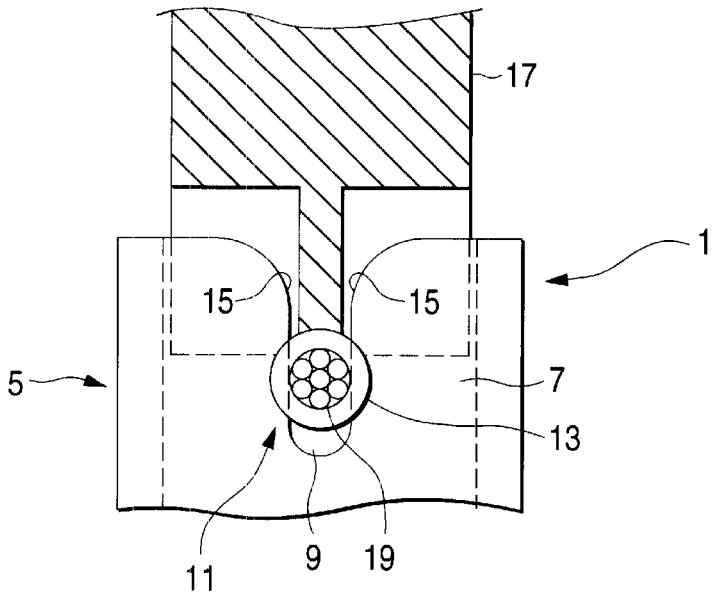
FIG. 5 PRIOR ART
FIG. 5 is a sectional view showing a state in which a coated electric wire is subjected to press-connecting treatment by a first conventional method.
Figure 6:
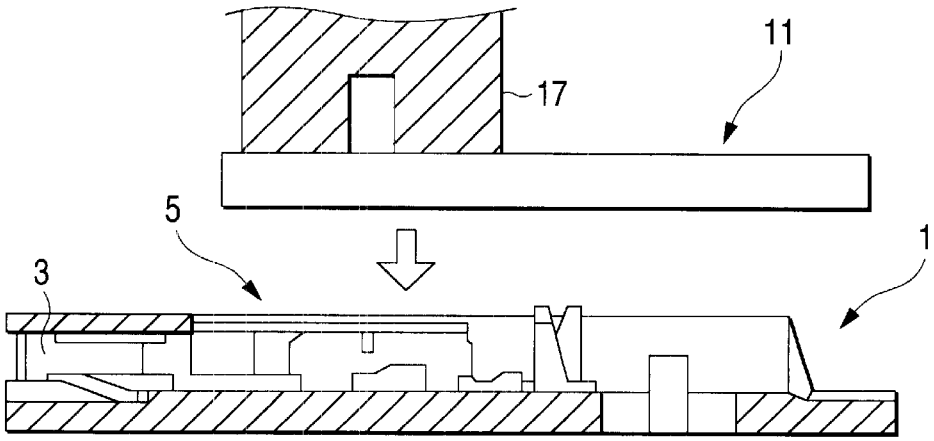
FIG. 6 PRIOR ART
FIG. 6 is a sectional view showing the first conventional method.
Figure 7:
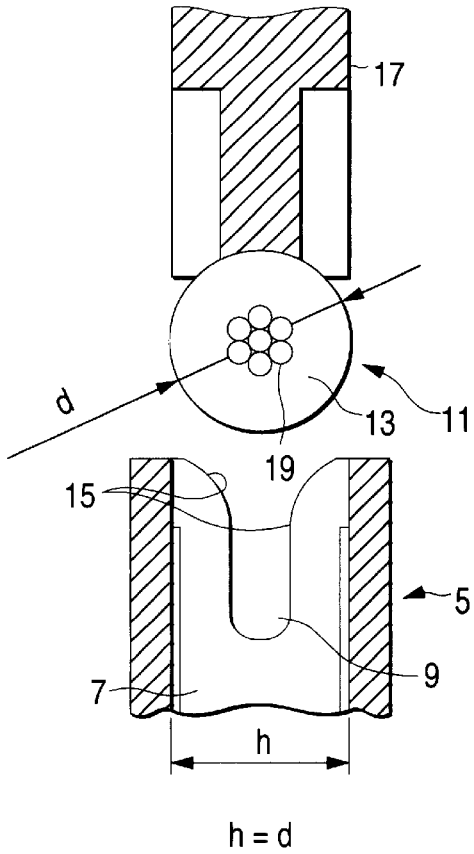
FIG. 7 PRIOR ART
FIG. 7 is a sectional view showing a state in which the coated electric wire has not yet been subjected to press-connecting treatment by the first conventional method.

Referring to FIGS. 3 and 4, a second embodiment of the present invention will be described below. Parts with no reference numerals in the following description are not shown in FIGS. 3 and 4.

As shown in FIGS. 3 and 4, an apparatus of press-connecting a coated electric wire 11 with a press-connecting terminal 1 according to this embodiment has a sleeve 21, and a pair of pressing arms 23 and 23 disposed in the inside of the sleeve 21. As described preliminarily in the conventional method, the pair of pressing arms 23 and 23 can swing so that the interval between the pair of pressing arms 23 and 23 is narrowed when the sleeve 21 is moved down in FIGS. 3 and 4.

The pair of pressing arms 23 and 23 are provided to serve also as heating means. The pair of pressing arms 23 and 23 are connected to a heater so as to be kept at a moderately high temperature.

As shown in FIG. 3, the pair of pressing arms 23 and 23 squash the coated electric wire 11 into a predetermined size in the direction of the width of the notched slot 9 while heating the coated electric wire 11 put between the pair of pressing arms 23 and 23 when the sleeve 21 is moved before press-connecting treatment.

As shown in FIG. 4, the coated electric wire 11 heated, softened and squashed is then pressed against the press-connecting portion 5 of the press-connecting terminal 1 by a press-connecting jig (press-connecting means) 25, so that the coating portion 13 is cut with the press-connecting blades 15 and 15 of the notched slot 9. As a result, the conductor 19 is electrically connected to the notched slot 9, so that the coated electric wire 11 is electrically connected so the press-connecting terminal 1.

The method and apparatus for press-connecting an electric wire with a press-connecting terminal according to the second embodiment are configured in the aforementioned manner.

The heating of the coated electric wire 11 by the pair of pressing arms 23 and 23 is performed in the same manner as in the first embodiment in such a temperature and time condition that a force of pressing the coated electric wire 11 into the press-connecting portion 5 is set to be not larger than a predetermined value due to the softening of the coating portion 13.

Because the coating portion 13 moderately softened as described above is cut thoroughly at the time of press-connecting treatment, the coating portion 13 is prevented from being squashed between the press-connecting jig 25 and the press-connecting portion 5. Accordingly, the notched slot 9 is prevented from being widened by the resistance of the squashed portion.

Accordingly, sufficient contact load is obtained between the conductor 19 and the notched slot 9, so that excellent electrical connection can be obtained between the coated electric wire 11 and the press-connecting terminal 1.

Further, because the coated electric wire 11 is squashed before press-connecting treatment, the cutting resistance of the coating portion 13 to widen the notched slot 9 at the time of press-connecting treatment is further reduced. Accordingly, the effect of preventing the notched slot 9 from being widened is improved.

Figure 9:
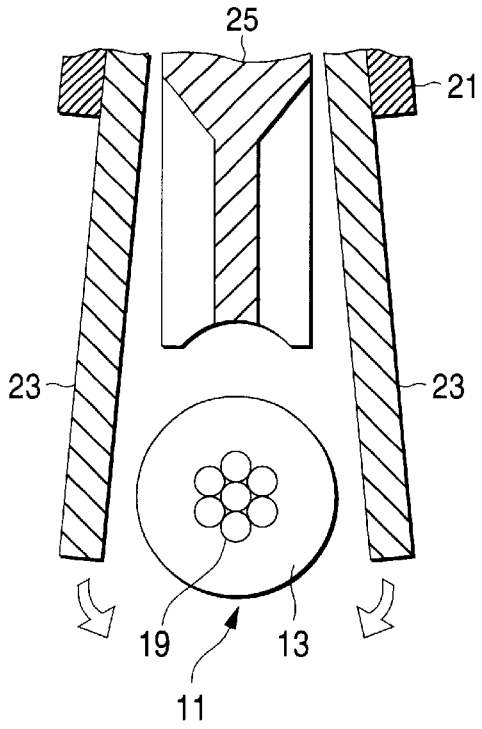
FIG. 9 PRIOR ART
FIG. 9 is a sectional view showing a state in which a coated electric wire has not been squashed yet in a second conventional method.
Figure 10:
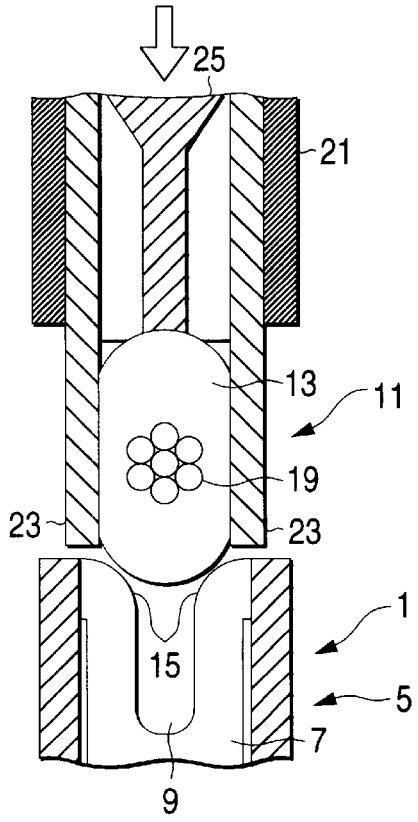
FIG. 10 PRIOR ART
FIG. 10 is a sectional view showing a state in which the coated electric wire has been already squashed in the second conventional method.
Figure 11:
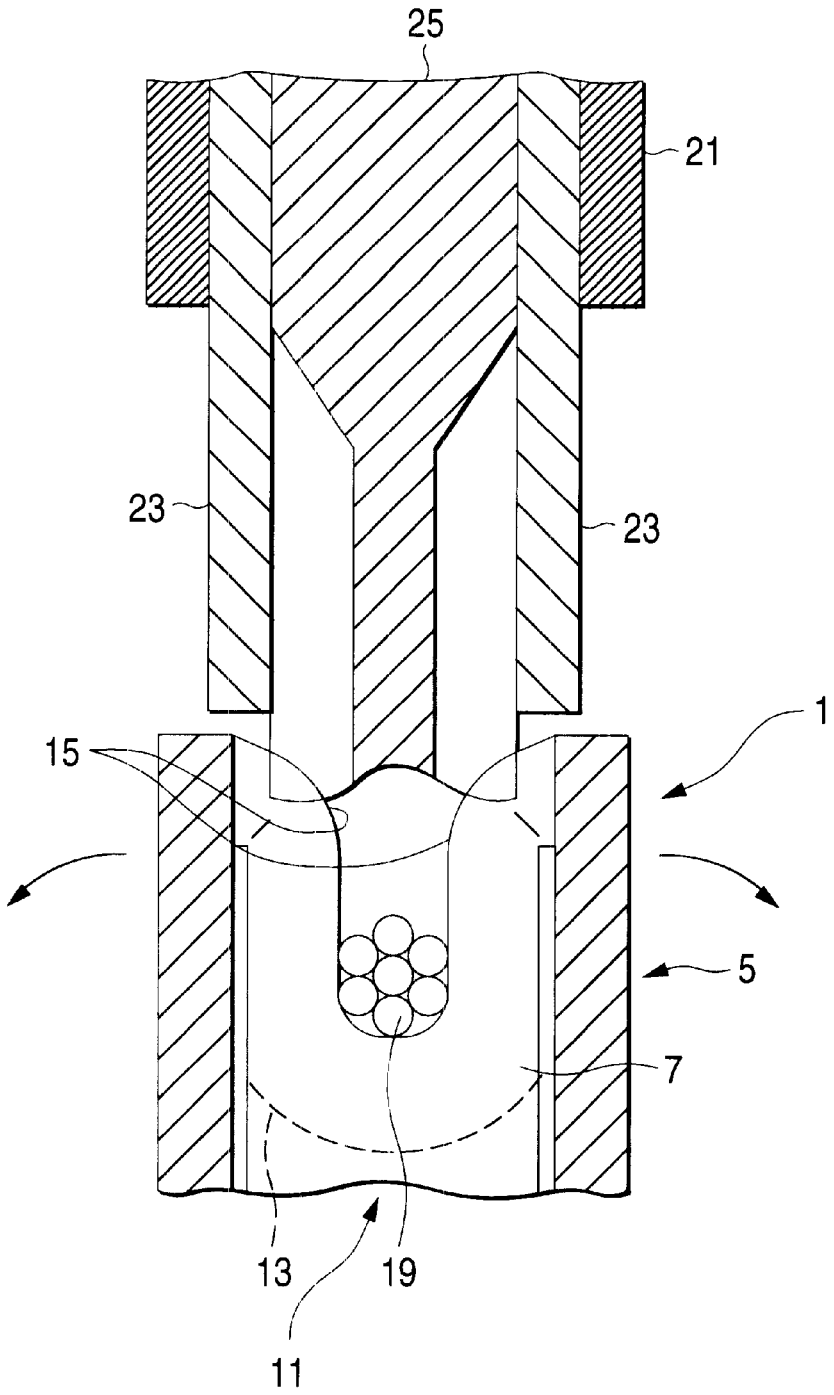
FIG. 11 PRIOR ART
FIG. 11 is a sectional view showing a state in which a force to widen the notched slot is generated by the elastically restoring force of the coating portion of the coated electric wire after press-connecting treatment in the second conventional method.

Further, because the electrically restoring force of the coating portion 13 squashed and plastically deformed in a softened state is reduced greatly, the notched slot 9 is prevented from being widened by the restoring force of the coating portion 13, unlike the conventional method shown in FIGS. 9 through 11. Accordingly, both the lowering of contact load between the notched slot 9 and the conductor 19 and the failure in electrical connection between the notched slot 9 and the conductor 19 can be prevented.

Further, because the coating portion 13 is softened and squashed, press-connecting treatment is performed normally even in the case where the center of the coated electric wire 11 is somewhat displaced from the center of the notched slot 9. Accordingly, the center of the coated electric wire 11 is allowed to be somewhat displaced from the center of the notched slot 9.

Further, because not only the notched slot 9 is prevented from being widened but also the thickness of each press-connecting terminal 1 can be further reduced, the interval or pitch between adjacent press-connecting terminals 1 received in one connector can be narrowed. Accordingly, the number of press-connecting terminals to be received in one connector can be increased correspondingly advantageously.

Further, because the pair of pressing arms 23 and 23 are provided to serve as heating means, there is no necessity of placing heaters in opposite sides of the coated electric wire 11. Accordingly, press-connecting workability is improved.

Further, because the coated electric wire is directly heated by the pair of pressing arms, heating efficiency is so good that the time required for heating is shortened. Accordingly, not only the workability is improved but also the heating energy can be saved.

As described above, in the present invention, the heating of the coated electric wire is performed in such a temperature and time condition that the force of pressing the coated electric wire into the press-connecting portion is set to be not larger than a predetermined value due to the softening of the coating portion. Upper and lower limits are set in each of the heating temperature and heating time. These limit values are determined in accordance with the diameter of the coated electric wire, the material quality of the coating portion, the softening speed of the coating portion corresponding to the heating thereof, etc.

In the method of press-connecting an electric wire with a press-connecting terminal according to the present invention, the following effects are obtained. The heating and softening of the coated electric wire prevents the notched slot from being widened at the time of press-connecting treatment, so that the coating portion is cut thoroughly. Accordingly, sufficient contact load is obtained between the conductor and the notched slot, so that excellent electrical connection is obtained between the coated electric wire and the press-connecting terminal.

Further, because not only the notched slot is prevented from being widened but also the thickness of each press-connecting terminal can be reduced, the interval or pitch between adjacent press-connecting terminals received in one connector can be narrowed. Accordingly, the number of press-connecting terminals to be received in one connector can be increased correspondingly.

Further, the softening of the coating portion allows the center of the coated electric wire to be somewhat displaced from the center of the notched slot.

In the apparatus for press-connecting an electric wire with a press-connecting terminal according to the present invention, the following effects are obtained. Because the coating portion heated and softened does not give any large cutting resistance so that the notched slot is not widened, the coating portion can be cut thoroughly, sufficient contact load can be obtained between the conductor and the notched slot, and excellent electrical connection can be obtained between the coated electric wire and the press-connecting terminal.

Further, because not only the notched slot is prevented from being widened but also the thickness of each press-connecting terminal can be reduced, the interval or pitch between adjacent press-connecting terminals received in one connector can be narrowed so that the number of press-connecting terminals to be received in one connector can be increased correspondingly.

Further, the center of the coated electric wire is allowed to be somewhat displaced from the center of the notched slot.

What is claimed is:

1. A method of press-connecting a coated electric wire with a press-connecting terminal, comprising the step of:

pressing an end portion of the coated electric wire into a notched slot provided in a side plate of the press-connecting terminal so as to cut a coating portion of the coated electric wire to thereby make a conductor of the coated electric wire electrically connected to the side plate of the press-connecting terminal, wherein before the coated electric wire is press-connected with the press-connecting terminal, the coating portion of the coated electric wire is heated and softened so that a force necessary for pressing the coated electric wire into the notched slot is reduced to be not larger than a predetermined value, wherein the heated and softened areas of the coating portion of the coated electric wire remain on the coated electric wire as it is forced into the press-connecting terminal.

2. An apparatus for press-connecting a coated electric wire with a press-connecting terminal, comprising:

pressing means for pressing an end portion of the coated electric wire into a notched slot provided in a side plate of the press-connecting terminal to thereby cut a coating portion of the coated electric wire to electrically connect a conductor of the coated electric wire to the side plate of the press-connecting terminal; and heating means for heating and softening the coating portion of the coated electric wire so that a force necessary for pressing the coated electric wire into the notched slot is reduced to be not larger than a predetermined value before the coated electric wire is press-connected with the press-connecting terminal.

3. An apparatus for press-connecting a coated electric wire with a press-connecting terminal, comprising:

pressing means for pressing an end portion of the coated electric wire into a notched slot provided in a side plate of the press-connecting terminal to thereby cut a coating portion of the coated electric wire to electrically connect a conductor of the coated electric wire to the side plate of the press-connecting terminal; and heating means for heating and softening the coating portion of the coated electric wire so that a force necessary for pressing the coated electric wire into the notched slot is reduced to be not larger than a predetermined value before the coated electric wire is press-connected with the press-connecting terminal, wherein the heated and electric wire remain on the coated electric wire as it is forced into the press-connecting terminal.

4. The apparatus according to claim 3, wherein said heating means is a pair of electric heaters disposed in the opposite sides of the coated electric wire.

5. The apparatus according to claim 3, further comprising a pair of pressing arms for squashing the coated electric wire in a direction of a width of the notched slot to make a size of the coated electric wire be a predetermined value before the coated electric wire is press-connected with the press-connecting terminal, said pair of pressing arms being designed to act as said heating means so as to heat and soften the coating portion of the coated electric wire to make the force necessary for pressing the coated electric wire into the notched slot reduced to be not larger than the predetermined value while squashing the coated electric wire.

6. The apparatus according to claim 5, wherein said pair of pressing arms are disposed in an inside of a sleeve of said apparatus, and an interval between said pair of pressing arms is varied when said sleeve is moved.

* * * * *